United States Patent [19]

Cobern et al.

[11] Patent Number: 4,894,923

[45] Date of Patent: Jan. 23, 1990

[54] METHOD AND APPARATUS FOR MEASUREMENT OF AZIMUTH OF A BOREHOLE WHILE DRILLING

[75] Inventors: Martin E. Cobern, Cheshire; Richard D. DiPersio, Meriden, both of Conn.; Edmund M. Hamlin, Tehachapi, Calif.

[73] Assignee: Alcan International Limited, Montreal, Canada

[21] Appl. No.: 54,552

[22] Filed: May 27, 1987

[51] Int. Cl.[4] ..... E21B 47/02

[52] U.S. Cl. ..... 33/304

[58] Field of Search ..... 33/304, 313, 312

[56] References Cited

U.S. PATENT DOCUMENTS

| | | | |
|---|---|---|---|
| 3,862,499 | 1/1975 | Isham et al. | 33/302 X |
| 4,472,884 | 9/1984 | Engebretson | 33/304 |
| 4,510,696 | 4/1985 | Roesler | 33/304 |
| 4,682,421 | 7/1987 | Dongen | 33/302 |
| 4,761,889 | 8/1988 | Cobern | 33/302 |

*Primary Examiner*—Harry N. Haroian

*Attorney, Agent, or Firm*—Cooper & Dunham

[57] ABSTRACT

A method and apparatus is presented for measuring the azimuth angle of a borehole being drilled, the data for determining the azimuth angle being obtained while the drillstring is rotating.

12 Claims, 2 Drawing Sheets

METHOD AND APPARATUS FOR MEASUREMENT OF AZIMUTH OF A BOREHOLE WHILE DRILLING

BACKGROUND OF THE INVENTION

This invention relates to the field of borehole measurement. More particularly, this invention relates to the field of measurement while drilling (MWD) and to a method of measuring the parameter of azimuth while the drill string is rotating.

Another patent application (Ser. No. 054,616, now U.S. Pat. No. 4,813,274) for an invention by Richard D. DiPersio and Martin E. Cobern for a different system for measuring azimuth while rotating is being filed contemporaneously herewith. Both applications are assigned to the assignee hereof.

In MWD systems, the conventional approach is to take certain borehole parameter readings or surveys only when the drillstring is not rotating. U.S. Pat. No. 4,013,945, owned by the assignee hereof, discloses and claims apparatus for detecting the absence of rotation and initiating the operation of parameter sensors for determining azimuth and inclination when the absence of rotation is sensed. While there have been several reasons for taking various MWD measurements only in the absence of drill string rotation, a principal reason for doing so for the drillers angles of azimuth and inclination is that previous methods for the measurement or determination of these angles required the tool to be stationary in order for the null points of single axis devices to be achieved or to obtain the averaging necessary when triaxial magnetometers and triaxial accelerometers are used for determining azimuth and inclination. That is, when triaxial magnetometers and accelerometers are used, the individual field measurements necessary for determination of azimuth and inclination are dependent on instantaneous tool face angle when the measurements are taken. This is so because during rotation the x and y axis magnetometer and accelerometer readings are continually varying, and only the z axis reading is constant. (In referring to x, y and z axis, the frame of reference is the borehole (and the measuring tool), with the z axis being along the axis of the borehole (and tool), and with the x and y axes being mutually perpendicular to the z axis and each other. That frame of reference is to be distinguished from the earth frame of reference of east (E), north (N) (or horizontal) and vertical (D) (or down).

There are, however, circumstances where it is particularly desirable to be able to measure azimuth and inclination while the drillstring is rotating. This requirement has led to the present invention of a method for measurement of azimuth and inclination while drilling. Examples of such circumstances include (a) wells where drilling is particularly difficult and any interruption in rotation will increase drill string sticking problems, and (b) situations where knowledge of instantaneous bit walk information is desired in order to know and predict the real time path of the borehole. A system has heretofore been proposed and used for obtaining inclination while the drillstring is rotating. The present invention also makes it possible to obtain azimuth while rotating.

DESCRIPTION OF THE PREFERRED EMBODIMENT

The method of the present invention is intended to be implemented in conjunction with the normal commercial operation of a known MWD system and apparatus of Teleco Oilfield Services Inc. (the assignee hereof) which has been in commercial operation for several years. The known system is offered by Teleco as its CDS (Computerized Directional System) for MWD measurement; and the system includes, inter alia, a triaxial magnetometer, a triaxial accelerometer, control, sensing and processing electronics, and mud pulse telemetry apparatus, all of which are located downhole in a rotatable drill collar segment of the drill string. The known apparatus is capable of sensing the components Gx, Gy and Gz of the total gravity field Go; the components Hx, Hy and Hz of the total magnetic field Ho; and determining the tool face angle and dip angle (the angle between the horizontal and the direction of the magnetic field). The downhole processing apparatus of the known system determines azimuth angle (A) and inclination angle (I) in a known manner from the various parameters. See e.g., the article "Hand-Held Calculator Assists in Directional Drilling Control" by J. L. Marsh, *Petroleum Engineer International,* July & September, 1982.

Figure 1:
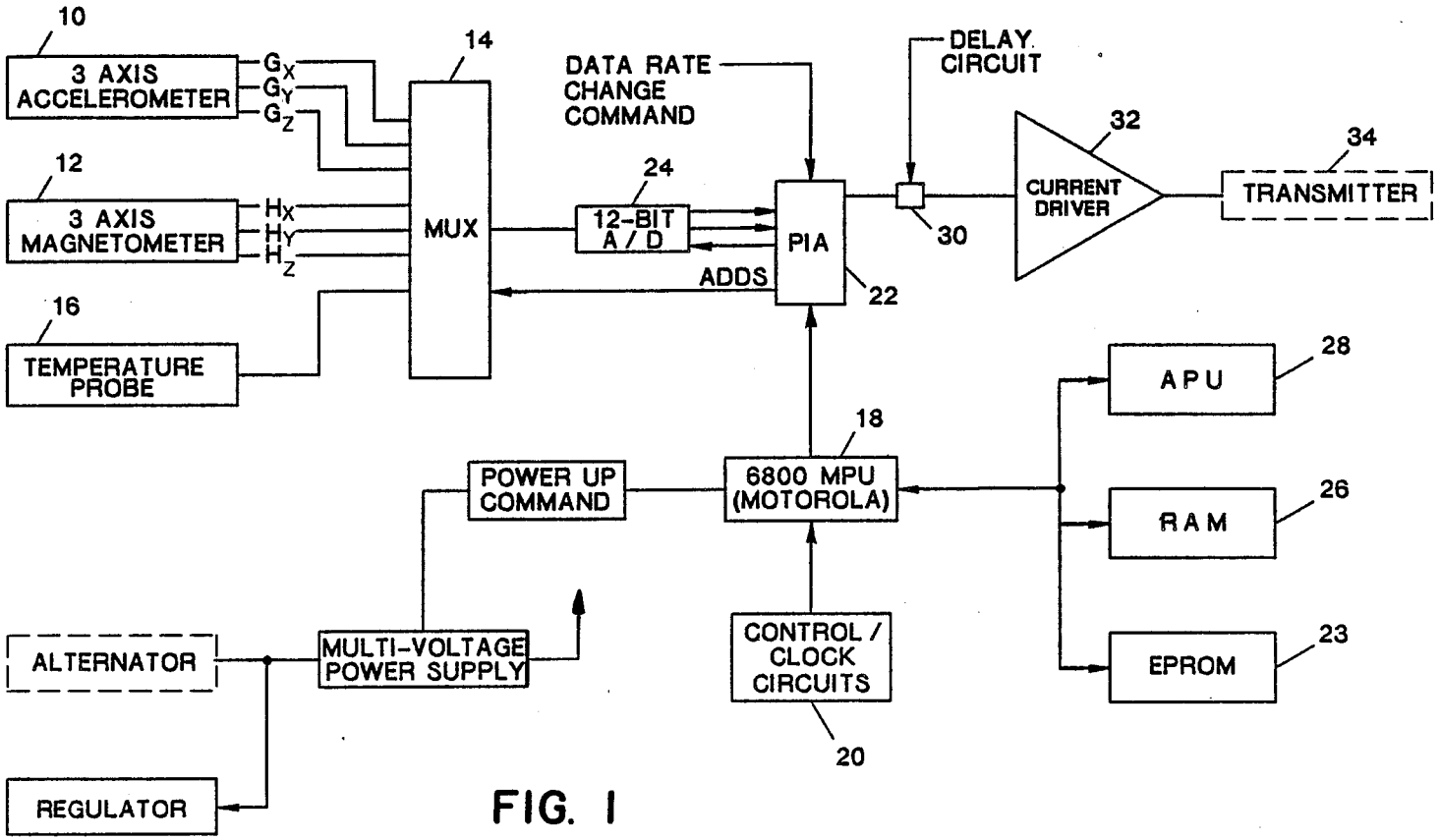
FIG. 1 is a block diagram of a measurement while drilling (MWD) system in accordance with the prior art.

Referring to FIG. 1, a block diagram of the known CDS system of Teleco is shown. This CDS system is located downhole in the drill string in a drill collar near the drill bit. This CDS system includes a 3-axis accelerometer 10 and a 3-axis magnetometer 12. The x axis of each of the accelerometer and the magnetometer is on the axis of the drillstring. To briefly and generally describe the operation of this system, accelerometer 10 senses the Gx, Gy and Gz components of the downhole gravity field Go and delivers analog signals commensurate therewith to a multiplexer 144. Similarly, magnetometer 12 senses the Hx, Hy and Hz components of the downhole magnetic field. A temperature sensor 16 senses the downhole temperature of the accelerometer and magnetometer and delivers a temperature compensating signal to multiplexer 14. The system also has a programmed microprocessor unit 18, system clocks 20 and a peripheral interface adapter 22. All control, calculation programs and sensor calibration data are stored in EPROM Memory 23.

Under the control of microprocessor 18, the analog signals to multiplexer 14 are multiplexed to the analog-to-digital converter 24. The output digital data words from A/D converter 24 are then routed via peripheral interface adapter 22 to microprocessor 18 where they are stored in a random access memory (RAM) 26 for the calculation operations. An arithmetic processing unit (APU) 28 provides off line high performance arithmetic and a variety of trigonometry operations to enhance the power and speed of data processing. The digital data for each of Gx, Gy, Gz, Hx, Hy, Hz are averaged in arithmetic processor unit 24 and the data are used to calculate azimuth and inclination angles in microprocessor 18. These angle data are then delivered via delay circuitry 30 to operate a current driver 32 which, in turn, operates a mud pulse transmitter 34, such as is described, for example, in U.S. Pat. No. 4,013,945.

In the prior art normal operation of the CDS system, the accelerometer and magnetometer readings are taken during periods of nonrotation of the drill string. As many as 2000 samples of each of Gx, Gy, Gz, Hx, Hy and Hz are taken for a single reading, and these samples are averaged in APU 26 to provide average readings for each component. A procedure has also previously been implemented to determine inclination (I) while the drill string was rotating. In that procedure, the Gz component of the gravity field is determined from an average of samples obtained while rotating, and the inclination angle (I) is determined from the simple relationship $$\tan(I) = \frac{\sqrt{Go^2 - Gz^2}}{Gz} \quad (1)$$

where Go is taken to be 1 G (i.e., the nominal value of gravity). This system is acceptable for measuring inclination while rotating, because the z axis component Gz is not altered by rotation.

In the operation of the known CDS system, the outputs of the triaxial accelerometer 10 and the triaxial magnetometer 12 while the tool is stationary are used to derive azimuth. The values of Gx, Gy and Gz and Hx, Hy and Hz are sensed while the tool is rotating, and are stored in RAM 26.

As many as 2000 or more readings of each x, y and z component may be taken for a single set of readings, and the values are averaged. The azimuth angle is then calculated in microprocessor 18 from the equation $$(A) = \text{arc tan} \frac{Hx\,Gy - Hy\,Gx\,(/Go/)}{Hz\,(Gx^2 + Gz^2) + Gz\,(Hx\,Gx + Hy\,Gy)} \text{ where} \quad (2)$$

$$/Go/ = \sqrt{Gx^2 = Gy^2 + Gz^2}$$

The value of azimuth (or tan (A)) is then transmitted to the surface by transmitter 34.

It is easily demonstrated that small bias errors will result in an azimuth error which varies sinusoidally with the tool face reference angle (i.e., the tool's orientation about its own axis). The effect of this error is eliminated by allowing the tool to rotate at least once and preferably several times about its axis during the measurement; but this then requires that azimuth be measured while rotating. As the tool rotates, the individual x and z sensor outputs of both accelerometer 10 and magnetometer 12 will vary sinusoidally and average to zero over many rotations. However, in the above equation (2) for azimuth, both the numerator and denominator are invariant under rotation about the tool axis, i.e., about the Z axis. This can be understood by reexpressing Eq. (2) as $$(A) = \text{arc tan} \frac{(H \times G)Z/Go/}{Hz(/Go/^2 - Gz^2) + Gz(H \cdot G - HzGz)} \quad (3)$$

In equation (3), each term is either an invariant scaler (i.e., a dot product or vector length) of the Z component of a vector or vector cross product. Since the Z axis of the tool remains stationary under rotation, the numerator and denominator will be unchanged by rotation except for random variation and the effects of sensor errors (which should average to zero over each rotation). The signs of the numerator and denominator will preserve the necessary quandrant information. Thus in the present invention we may calculathe the numerator and denominator (or the invariant components thereof) of Equation (2) from each instantaneous set of measurements Gx, Gy, Gz, Hx, Hy, Hz and average these calculated invariant values over the entire survey period to obtain the value of azimuth from Equation (3).

In accordance with a first embodiment of the present invention, a single set of the raw data Gx, Gy, Gz, Hx, Hy, Hz is sent to RAM 26. From the single set of data, the following invariants of equation (2) are calculated by MPU 18 as follows:

(1) $HxGy - HyGx$
(2) $Gx^2 + Gy^2$
(3) $HxGx + HyGy$
(4) $Gz$
(5) $Hz$

The invariants for each instantaneous reading are then stored in RAM 26. This process is repeated, preferably at least several hundred times, and the invariant values determined for each cycle are then averaged. The averaged values of the invariants (1)–(5) are used to calculate azimuth from equation (2). The calculated value of azimuth is then transmitted to the surface by transmitter 34.

It is recognized that the accuracy of any instantaneous set of readings may be affected by the fact that the tool is rotating. For example, since in the first embodiment all measurements in one set are taken sequentially, the tool will have rotated some small amount during each set of readings so that each set is taken only approximately instantaneously. One way to reduce that effect is to pair and average the readings. That is, two sets of instantaneous readings can be taken in a predetermined mirror image sequence, such as GzHzGxGyHxHyHyHxGyGxHzGz For each paired set of such readings, the two successive readings of each parameter are in pairs equally spaced about the center of the set (which is between HyHy in the above sequence). Each pair of reading is then averaged to reduce the effects on accuracy due to the fact that the tool is rotating while the measurements are being taken; and one set of invariants (1)–(5) are determined from these average paired values.

As discussed up to this point, the process of the present invention can be practiced by transmitting the calculated invariants (1)–(5) to the surface for surface computation; or the process can be practiced with the calculations being performed downhole and the azimuth information being transmitted to the surface. In either case, the downhole aspects of the process will be carried out under the program control of microprocessor 18 by means of any suitable program within the ordinary skill of the art or by modification of the existing program in the CDS unit, such modification being within the ordinary skill in the art.

The value of the inclination angle I may also be determined while rotating in a known manner from $$\text{Cos } I = (Gz/Go)$$

and sent to the surface.

Figure 2:
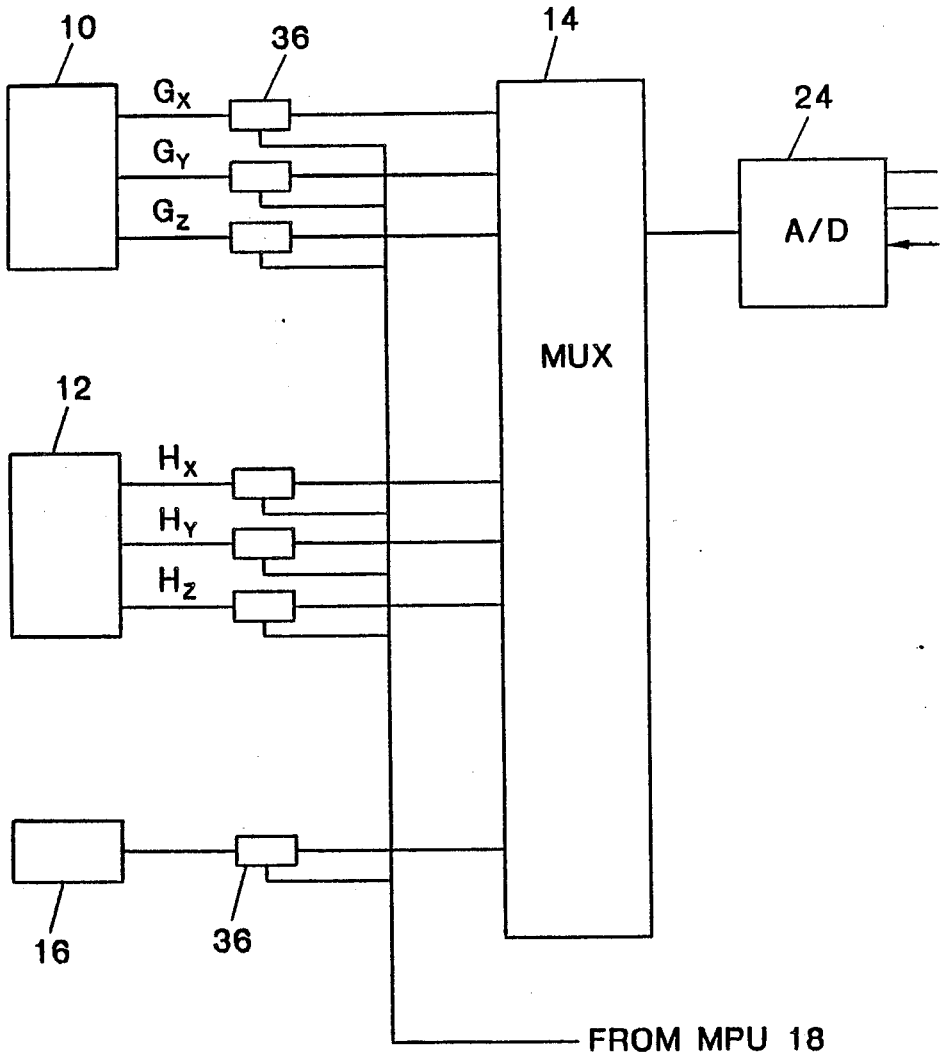
FIG. 2 is a block diagram of a circuit for implementing the process of the present invention.

The process of the present invention may also be implemented in a second embodiment which includes a modification to the system shown schematically in FIG. 1. Referring to FIG. 2, sample and hold circuits 36 are included in the system, one each connected between multiplexer 14 and each of the x, y and z component sensors of accelerometer 10 and magnetometer 12 and temperature compensating sensor 16. Each of the sample and hold circuits 36 is connected to receive operating signals from MPU 18 as shown. Except as shown in FIG. 2 for the addition of the sample and hold circuits 36 and their connection to MPU 18, the hardware of the system of FIG. 1 is unchanged. In this embodiment of the invention, all six sensors of accelerometer 10, magnetometer 12 and the temperature sensor 16 are read simultaneously to take a "snap shot" of the magnetic and gravity components. That is, a full set of measurements Gx, Gy, Gz, Hx, Hy, Hz (and temperature if necessary) are all taken at the same time, and each measurement is delivered to and held in its respective sample and hold circuit 36. Multiplexer 14 then samples each sample and hold circuit 36 sequentially to deliver the data sequentially to A/D converter 24 and then to RAM 26 for storage. These stored data commensurate with an instantaneous value of Gx, Gy, Gz, Hx, Hy and Hz are then compensated for temperature by the input from temperature sensor 16. MPU 18 then calculates or determines the following invariant parts of equation (2):

(1) (HxGy−HyGx)
(2) ($Gx^2+Gy^2$)
(3) (HxGx+HyGy)
(4) Gz
(5) Hz

These calculated or determined invariant values are then stored in RAM 26. Over a time T a number of "snap shot" sets of such readings are taken and the above calculations made, and the calculations and Gz and Hz are averaged over time T. Then, microprocessor 18 performs the calculation of equation (2) based on the averaged values to obtain tan (A). The azimuth angle information (either in the form of tan (A) or as (A)) is then transmitted to the surface by transmitter 34.

The apparatus and method of this second embodiment eliminate the concern about taking reading within a limited short angular distance of travel of the tool as in the first embodiment.

It is to be noted that for either embodiment of the present invention errors in the x and y accelerometer readings due to centripital acceleration effects are cancelled out by the averaging technique employed in this invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method for determining the azimuth angle of a borehole being drilled by instruments contained downhole in the drillstring, including the steps of:

(1) sensing with accelerometer means while the drillstring is rotating the components Gx, Gy and Gz of the total gravity field Go at the location of the instrument;
(2) sensing with magnetometer means while the drillstring is rotating the components of Hx, Hy and Hz of the total magnetic field Ho at the location of the instrument;
(3) the components Gz and Hz being along the axis of the drillstring, the components Gx and Gy being orthogonal to Gz and the components Hx and Hz being orthogonal to Hz;
(4) determining from a predetermined set of measurements of Gx, Gy, Gz, Hx, Hy, Hz the invariant quantities
(a) HxGy−HyGx
(b) $Gx^2+Gy^2$
(c) HxGx+HyGy
(d) Gz
(e) Hz
(5) determining azimuth angle A from the relationship $$A = \arctan = \frac{HX\,Gy - Hy\,Gx\,(/Go/)}{Hz\,(Gx^2 + Gz^2) + Gz\,(Hx\,Gx + Hy\,Gy)}$$

where $$/Go/ = \sqrt{Gx^2 = Gy^2 + Gz^2}$$

2. The method of claim 1 wherein:
steps (1) and (2) are repeated;
step (4) is repeated for each repetition of steps (1) and (2) to obtain average values for the invariants (a)-(e); and
the azimuth angle determined according to step (5) is determined from the average values of invariants (a)-(e).

3. The method of claim 2 wherein:
each set of measurements Gx, Gy, Gz, Hx, Hy, Hz is obtained at the same time.

4. The method of claim 1 wherein:
each set of measurements Gx, Gy, Gz, Hx, Hy, Hz is obtained at the same time.

5. The method of claim 1 wherein the components are sensed in a mirror image sequence.

6. The method of claim 5 wherein the mirror image sequence is

GzHzGxGyHxHyHyHxGyGxHzGz.

7. Apparatus for determining the azimuth angle of a borehole being drilled by instruments contained downhole in the drillstring, including:

accelerometer means for sensing while the drillstring is rotating the components Gx, Gy and Gz of the total gravity field Go at the location of the instrument;
magnetometer means for sensing while the drillstring is rotating the components of Hx, Hy and Hz of the total magnetic field Ho at the location of the instrument;
the components Gz and Hz being along the axis of the drillstring, the components Gx and Gy being orthogonal to Gz and the components Hx and Hz being orthogonal to Hz;
means for determining from a predetermined set of measurements of Gx, Gy, Gz, Hx, Hy, Hz the invariant quantities
(a) HxGy−HyGx
(b) $Gx^2+Gy^2$
(c) HxGx+HyGy
(d) Gz
(e) Hz means for determining azimuth angle A from the relationship $$A = \arctan = \frac{HX\,Gy - Hy\,Gx\,(/Go/)}{Hz\,(Gx^2 + Gz^2) + Gz\,(Hx\,Gx + Hy\,Gy)}$$

where $$/Go/ = \sqrt{Gx^2 = Gy^2 + Gz^2}$$

8. The apparatus of claim 7 including:

means for obtaining average values for the invariants (a)-(e); and means for determining the azimuth angle from the average values of invariants (a)-(e).

9. The apparatus of claim 8 including:

means for obtaining each set of measurements Gx, Gy, Gz, Hx, Hy, Hz at the same time.

10. The apparatus of claim 7 including:

means for obtaining each set of measurements Gx, Gy, Gz, Hx, Hy, Hz at the same time.

11. The apparatus of claim 7 including:

means for storing and holding a full set of readings Gx, Gy, Gz, Hx, Hy, Hz taken at the same time.

12. The apparatus of claim 11 including:

means for determining the invariants (a)-(e) for each full set of said readings; and means for averaging said invariants (a)-(e) for use in determining the azimuth angle.

* * * * *

UNITED STATES PATENT AND TRADEMARK OFFICE

CERTIFICATE OF CORRECTION

PATENT NO. : 4,894,923

DATED : January 23, 1990

INVENTOR(S) : Martin E. Cobern et al

It is certified that error appears in the above-identified patent and that said Letters Patent is hereby corrected as shown below:

On the title page:

In [73], change the "Assignee" from "Alcan International Limited, Montreal, Canada" to - - Teleco Oilfield Services, Inc., Meriden, Connecticut - - .

In [56], change the "Attorney, Agent or Firm" from "Cooper & Dunham" to - - Fishman, Dionne and Cantor - - .

Signed and Sealed this

Twelfth Day of March, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,894,923

DATED : 23 January 1990

INVENTOR(S) : Martin E. Cobern

It is certified that error appears in the above-identified patent and that said Letters Patent is hereby corrected as shown below:

Column 6, line 5, change "Hz" to "Hy".

Column 6, line 60, change "Hz" to "Hy".

Signed and Sealed this

Thirteenth Day of October, 1992

*Attest:*

DOUGLAS B. COMER

*Attesting Officer*

*Acting Commissioner of Patents and Trademarks*